US006279446B1

(12) United States Patent
Halket et al.

(10) Patent No.: US 6,279,446 B1
(45) **Date of Patent: *Aug. 28, 2001**

(54) TAPE CUTTING APPARATUS

(75) Inventors: Andrew Richard Halket, Cambridge; Charles Robert Sims, Royston, both of (GB)

(73) Assignee: Esselte N.V. (BE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/833,755

(22) Filed: Apr. 9, 1997

Related U.S. Application Data

(62) Division of application No. 08/703,841, filed on Aug. 27, 1996, now Pat. No. 5,695,705, which is a continuation of application No. 08/180,242, filed on Jan. 11, 1994, now abandoned.

(30) Foreign Application Priority Data

Jan. 13, 1993 (GB) ..... 9300579

(51) Int. Cl.[7] ..... B26D 3/08
(52) U.S. Cl. ..... 083/879; 156/268; 156/510
(58) Field of Search ..... 83/861, 879, 881, 83/880, 882–887; 400/621; 30/2, 293, 294; 156/522, 510, 257, 268

(56) References Cited

U.S. PATENT DOCUMENTS

| | | | | |
|---|---|---|---|---|
| 2,889,623 | * | 6/1959 | Baker . | |
| 3,292,513 | * | 12/1966 | Palmer | 83/881 X |
| 3,555,950 | * | 1/1971 | Gijsbers . | |
| 3,871,253 | * | 3/1975 | Pryce et al. | 83/881 |
| 4,001,934 | * | 1/1977 | Bell . | |
| 4,106,196 | * | 8/1978 | Smithline | 30/294 |
| 4,536,957 | * | 8/1985 | Britton | 30/90.4 |
| 4,715,122 | | 12/1987 | Lindén | 30/254 |
| 4,905,558 | * | 3/1990 | Corcoran | 83/881 X |
| 5,066,152 | * | 11/1991 | Kuzuya et al. | 83/881 X |
| 5,160,573 | * | 11/1992 | Takagi et al. | 83/881 X |
| 5,271,789 | * | 12/1993 | Takagi et al. | 83/861 X |
| 5,601,007 | * | 2/1997 | Clough et al. | 83/879 X |
| 5,605,087 | * | 2/1997 | Beadman | 83/881 |
| 5,697,157 | * | 12/1997 | Votolato | 30/2 |

FOREIGN PATENT DOCUMENTS

| | | | |
|---|---|---|---|
| 737004 | * | 7/1943 | (DE) . |
| 0 319 209 A3 | | 6/1989 | (EP) . |
| 0 468 900 A1 | | 7/1990 | (EP) . |
| 0 478 246 A1 | | 4/1991 | (EP) . |
| 0 462 807 A1 | | 12/1991 | (EP) . |
| 0 488 998 A3 | | 6/1992 | (EP) . |
| 1 165 971 | | 10/1969 | (GB) . |
| 1 428 365 | | 3/1976 | (GB) . |
| WO 89/04746 | | 11/1987 | (WO) . |

* cited by examiner

*Primary Examiner*—Kenneth E. Peterson
(74) *Attorney, Agent, or Firm*—Pennie & Edmonds LLP

(57) ABSTRACT

A blade assembly particularly for preforming a tab cut in a label. The blade assembly comprises a blade received in an injection molded plastics holder. The holder has shoulders on either side of the blade to assist in locating it and spacing it from a label to be cut. During manufacture, the blade is located within the mold for accurate injection molding.

8 Claims, 6 Drawing Sheets

FIG. 4a
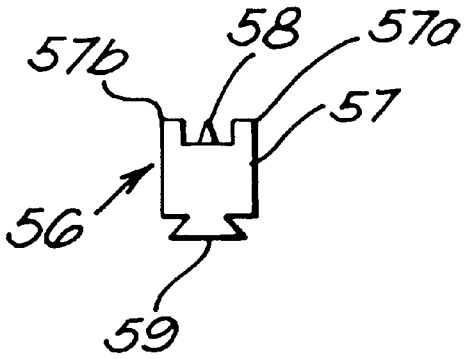
FIG. 4b
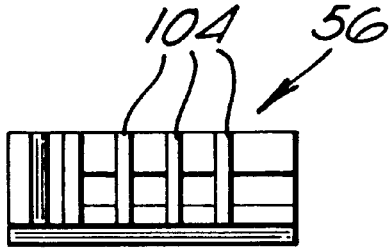
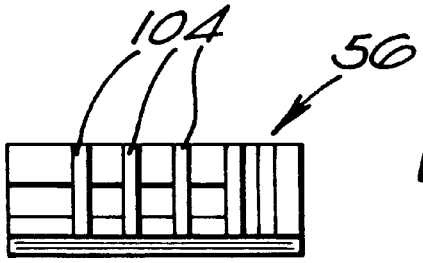
FIG. 4c
FIG. 4d
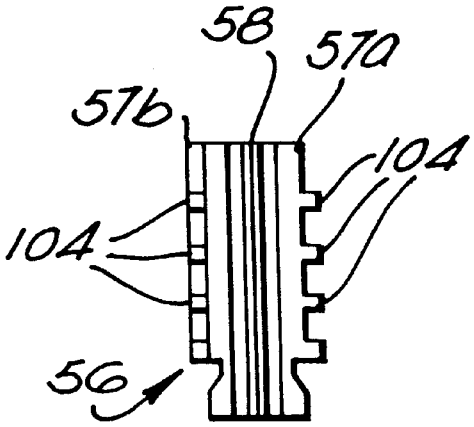
FIG. 4e
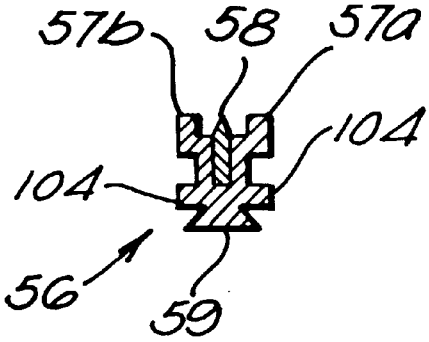

TAPE CUTTING APPARATUS

This is a division of application Ser. No. 08/703,841, filed Aug. 27, 1996, now U.S. Pat. No. 5,695,705 which is a continuation of abandoned application 08/180,242 filed Jan, 11, 1994.

FIELD OF THE INVENTION

This invention relates to a tape cutting apparatus and is particularly concerned with cutting tape in printing devices.

BACKGROUND OF THE INVENTION

Thermal printing devices of the general type with which the present invention is particularly but not exclusively concerned are known. They operate with a supply of tape arranged to receive an image and a means for transferring an image onto the tape. In one known device, a tape holding case holds a supply of image receiving tape and a supply of an image transfer ribbon, the image receiving tape and the transfer ribbon being passed in overlap through a printing zone of the printing device. At the print zone, a thermal print head cooperates with a platen to transfer an image from the transfer ribbon to the tape. A printing device operating with a tape holding case of this type is described for example in EP-A-0267890 (Varitronics, Inc.). Other printing devices have been made in which letters are transferred to an image receiving tape by a dry lettering or dry film impression process. In all of these printing devices, the construction of the image receiving tape is substantially the same. That is, it comprises an upper layer for receiving an image which is secured to a releaseable backing layer by a layer of adhesive.

Once an image or message has been printed on the tape, it is desired to cut off that portion of the tape to enable it to be used as a label. For this purpose, it is necessary to remove the releaseable backing layer from the upper layer to enable the upper layer to be secured to a surface by means of the adhesive layer. With existing printing devices, it is difficult to remove the releaseable backing layer from the upper layer: it is necessary first to separate the closely adhered end portions of the releaseable backing layer and the upper layer, for example using a fingernail or tweezers so that the separated end portion of the releaseable backing layer can be finger gripped to peel it off the adhesive layer. This is a relatively difficult procedure and furthermore can result in the ends of the label being damaged in the process.

There have been several attempts to solve this problem. One approach is to provide a so-called tab cut. In these devices, a first cut is made completely through all the layers of the tape to cut off a portion of the tape and at the same time a cut is made through only one layer of the tape. This provides a "tab" which, in theory, can be peeled away reasonably easily. In embossing label makers a system is known whereby a sharp steel blade is used to cut the plastic label against a soft, serrated anvil, such that the soft plastic backing layer remains substantially intact. Such a system does not work satisfactorily with electronic label makers as the backing layer used is normally paper and the plastic label tape is thinner than normal embossing tape. Any attempt to use a similar approach in an electronic label printer would require high cutting forces and frequent replacement of the soft cutting anvil. Although there have been several proposals, no such tab cut has successfully been implemented in a thermal printing device. By way of example, reference is made to EP-A-0319209 which describes one attempt to form a tab cut system. In EP-A-319209, the tab cut is made only through the thickness of the backing layer which is applied as a release layer of double-sided adhesive tape.

In that system, two blades are provided on a cutter support, the blades having different heights so that they penetrate the backing layer to different extents. In this way, one blade cuts through all the layers of the tape at one location while the other blade cuts only through the releaseable backing layer.

One problem which arises with the tab cutting apparatus described in EP-A-0319209 is the control of the height of the blades to ensure that there is reliability in that one blade always cuts through the whole tape and the other blade only cuts through the backing layer. This is difficult to achieve where tapes of differing thicknesses are provided for use with the cutting apparatus. A variation in thickness such that could arise due to normal manufacturing tolerances could even give rise to problems in this respect.

Another difficulty is that the tab cut depends on making two cuts simultaneously from the common cutter support, requiring increased force to be applied by the user. The force is applied manually and the force applied by some users may be insufficient to provide a proper tab cut, causing the label to be damaged when the backing is removed. Conversely too great a force may cause both tapes to be fully cut in both positions, leaving a portion of material within the cutting mechanism.

These problems have meant that to date the above described system has not been successfully implemented.

In this regard reference is made to British Patent Application No. 9212423.9 in the name of the present applicant which describes a tape cutting apparatus in which a tab cut is implemented using a drive means to provide the force for the tab cutting blade. The contents of that Application are incorporated herein by reference.

A particularly important aspect to providing a successful implementation of a tab cut is to enable the depth of cut to be controlled carefully. Only in this way can a reliable tab cut be produced which cuts only through one layer of the multilayer tape leaving the remaining layers intact.

SUMMARY OF THE INVENTION

According to the present invention in one aspect there is provided a blade assembly which comprises an injection molded plastics holder receiving a cutting blade, the holder having supporting surfaces which extend beyond a surface of the holder from which the blade protrudes and which hold the tape and prevent the blade from piercing all the layers of a multilayer tape.

The tab cutting assembly is made by providing a mold, locating the cutting blade within the mold, injecting plastic material into the mold, and allowing the plastics material to set. The location of the cutting blade is done so that a very close tolerance can be achieved on the blade height of the order of 20 to 25 $\mu$m. Typically 100 to 120 microns of blade height is required for cutting through a 75 micron polyester tape with a total thickness of 135 microns including adhesive backing paper. The lower limit would be 95 $\mu$m instead of 100 $\mu$m. For polyester tape of a different thickness a different blade height would be required. Preferably the blade height is 20 to 45 $\mu$m greater than the thickness of the polyester tape.

According to another aspect of the invention there is provided a tape cutting apparatus comprising:

locating a cutting blade within a mold using at least one biased pin member, a cutting portion of the blade protruding from said mold;

injecting plastics material into the mold, and allowing the plastics material to set to form an injection molded plastics holder around said blade with an amount of the blade protruding from the holder which is less than the height of the holder; and removing said injection molded plastics holder from said mold.

This method aids in achieving the required close tolerance for the protruding blade height.

Preferably the cutting blade is made from a ceramic material since this typically requires as low as a half to one third the force of a steel blade for the same cut. In fact, it has been discovered that with the thin polyester material used as the image receiving tape, the blade does not actually cut the material in the normal sense of the word but rather cracks it. A ceramic blade is ideal for this.

Preferably, the tab cutting assembly forms part of a tape cutting apparatus which further includes a second cutting means which is operable to cut through all of the layers of said multilayer tape. In the described embodiment, the second cutting means is actuated by the same drive means as the tab cut blade so that a portion of tape can be cut off while a cut is also made through only one layer of the tape at a position spaced apart from the cut off edge. This enables labels with tabs to be produced.

The second cutting means can comprise two blades cooperable to form a scissor cut, for example in which one of the blades is fixed while the other of the blades is arranged to move towards the fixed blade when actuated by the drive means.

The holder of the tab cut assembly is preferably resiliently mounted and acts against an anvil which can form part of the tape cutting apparatus or can be provided as part of a thermal printing device with which the tape cutting apparatus is to cooperate.

Where both the tab cut assembly and the second cutting means are arranged to be driven from the common drive means, means can be provided for disconnecting the second cutting means while the tab cut assembly remains driven thereby. In this way, it is possible for a thermal printing device to produce a continuous strip of labels, separated one from another by a cut but being secured to a common backing layer.

For a better understanding of the present invention, and to show how the same may be carried into effect, reference will now be made by way of example, to the accompanying drawings.

BRIEF DESCRIPTION OF THE DRAWINGS

FIG. 4*a* is an end view of a tab cut assembly;

FIG. 4*b* is a side view of the tab cut assembly;

FIG. 4*c* is a view from the other side of the tab cut assembly;

FIG. 4*d* is a view onto the cutting surface of the assembly;

FIG. 4*e* is a transverse section through the assembly;

DESCRIPTION OF THE PREFERRED EMBODIMENT

Figure 1:
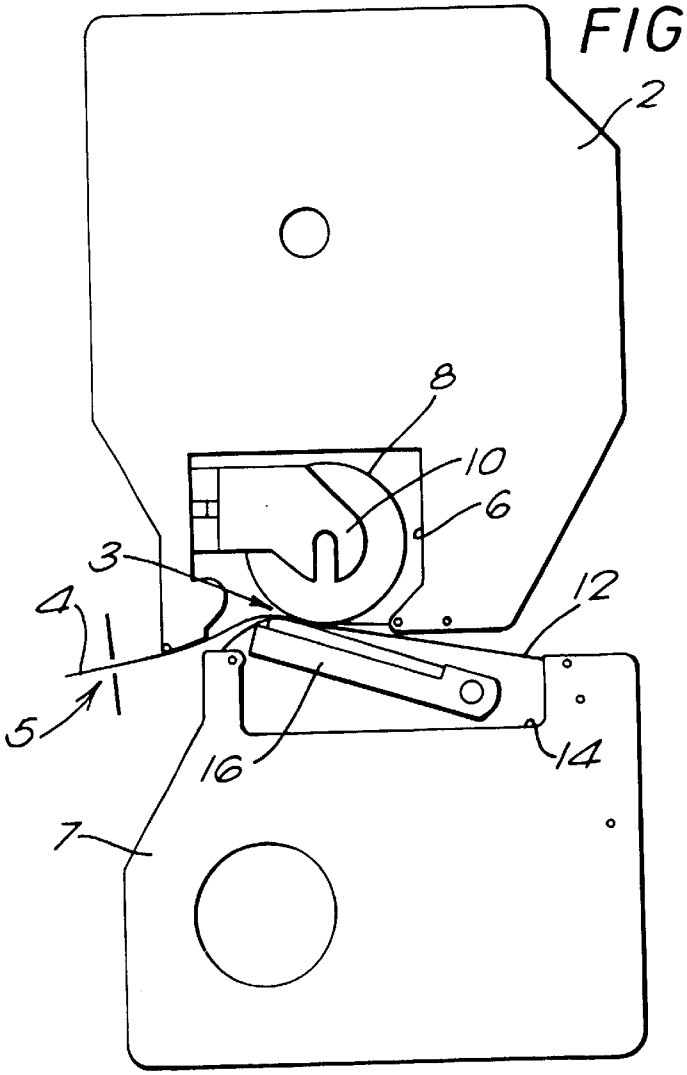
FIG. 1 is a plan view showing two cassettes inserted in a printing device.

FIG. 1 shows in plan view two cassettes arranged in a printing device. The upper cassette 2 contains a supply of image receiving tape 4 which passes through a print zone 3 of the printer to an outlet 5 of the printer. The image receiving tape 4 comprises an upper layer 4*a* for receiving a printed image on one of its surfaces and having its other surface coated with an adhesive layer to which is secured a releaseable backing layer 4*b* (see FIG. 5). The cassette 2 has a recess 6 for accommodating a platen 8 of the printer. The platen 8 is mounted for rotation within a cage molding 10. The platen 8 could as an alternative be mounted for rotation on a pin.

The lower cassette 7 contains a thermal transfer ribbon 12 which extends from a supply spool to a take-up spool within the cassette 7. The thermal transfer ribbon 12 extends through the print zone 3 in overlap with the image receiving tape 4. The cassette 7 has a recess 14 for receiving a print head 16 of the printer. The print head 16 is movable between an operative position, shown in FIG. 1, in which it is in contact with the platen 8 and holds the thermal transfer ribbon 12 and the image receiving tape 4 in overlap between the print head and the platen and an inoperative position in which it is moved away from the platen 8 to release the thermal transfer ribbon 12 and image receiving tape 4. In the operative position, the platen is rotated to cause image receiving tape to be driven past the print head and the print head is controlled to print an image onto the image receiving tape by thermal transfer of ink from the ribbon 12. The print head is a conventional thermal print head having an array of pixels each of which can be thermally activated in accordance with the desired image to be printed.

Figure 2:
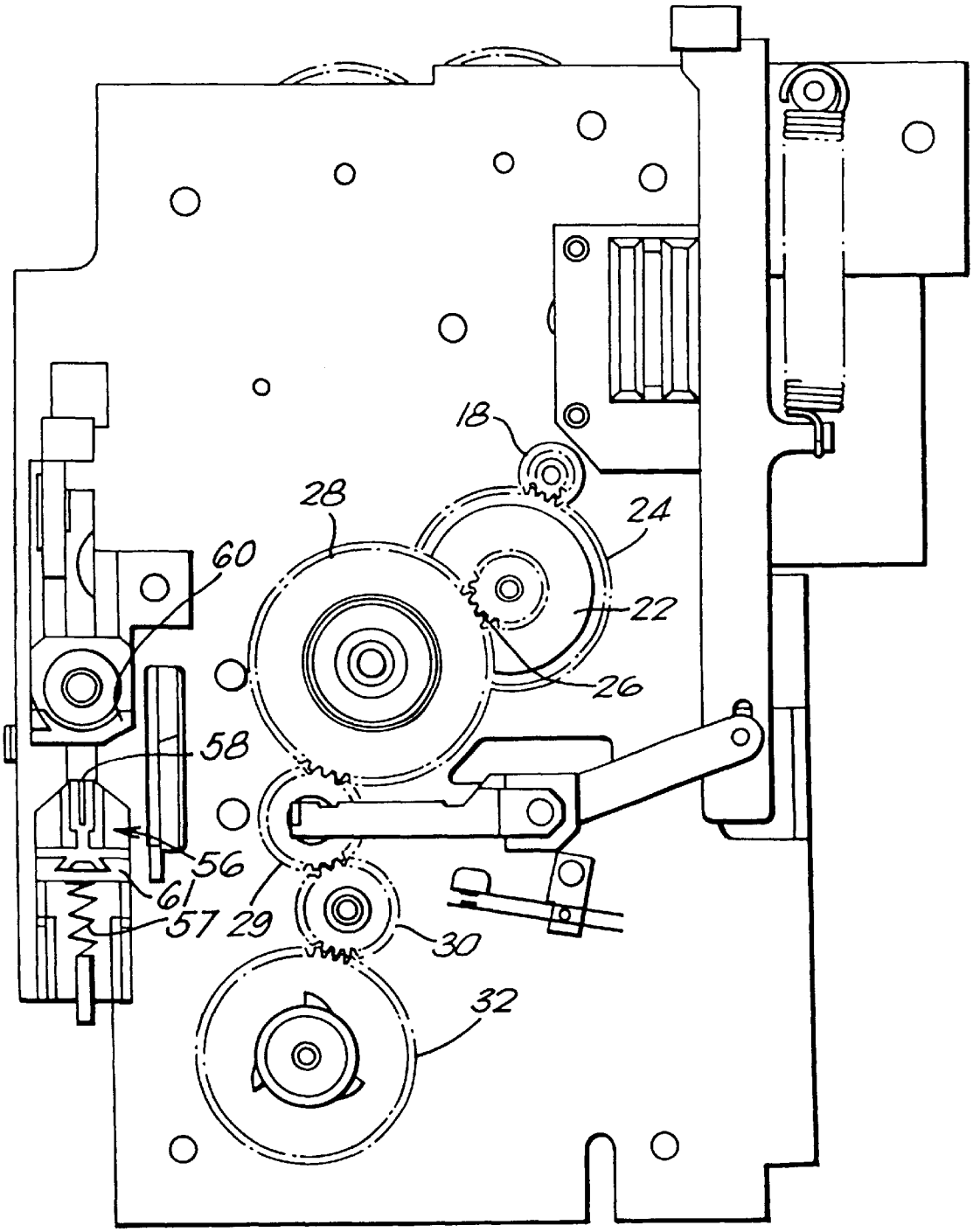
FIG. 2 is a plan view seen from the top of a cassette bay of the printing device.

FIG. 2 shows the drive train of the printing device. The printing device carries a stepper motor 18 secured to the base of the printing device by a bracket 20 (see FIG. 3). The motor drives a double radius gear 22 on its larger diameter 24 while its smaller diameter 26 drives a second gear wheel 28.

The second gear wheel 28 drives a gear 29 which causes the platen 8 to rotate and which also drives through an intermediate gear 30 a third gear 32 which drives the take-up spool for the ink ribbon in the cassette 4.

The stepper motor 18 drives the platen 8 in steps so that for each position of the platen a column of pixels is printed on the image receiving tape 4. The platen 8 drives the image receiving tape through the print zone under the action of its own rotation. The rotation of the platen and the energisation of the print head 16 are controlled by a microprocessor as described in our British Application No. 9212423.9, the contents of which are incorporated herein by reference.

FIG. 2 also shows a tab cutting assembly comprising a spring loaded blade holder designated generally by reference numeral 56 holding a blade 58 which can be forced against an anvil 60. The blade holder 56 is biased by a spring 57. In an alternative arrangement, the anvil 60 could be biased instead of the blade holder 56. The blade 58 is not designed to cut entirely through the tape but is designed to cut only through the image receiving layer 4*a* of the image receiving tape 4 and not through the releaseable backing layer 4*b*.

Figure 3:
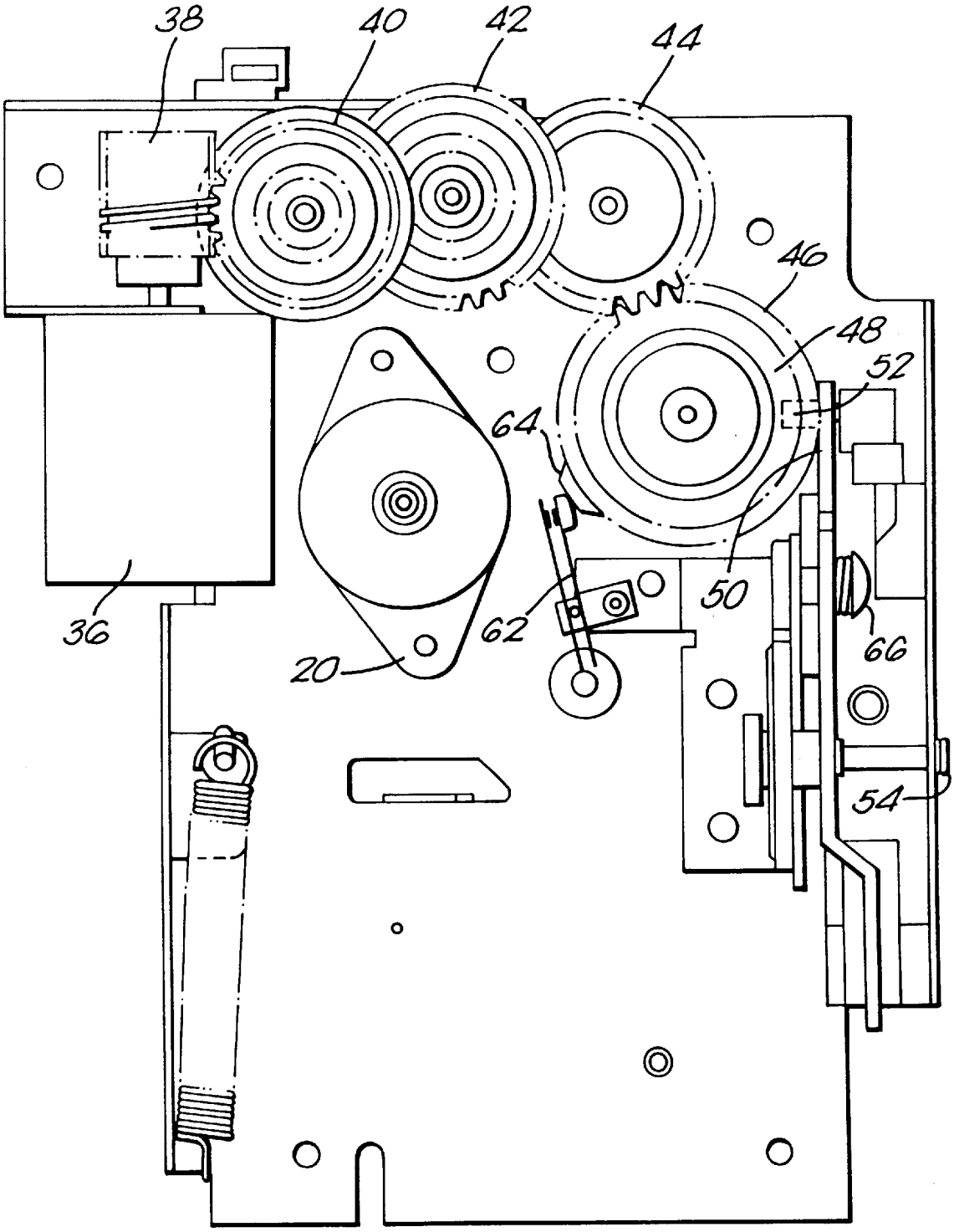
FIG. 3 is a view taken from the underneath of the bay of a printing device.

FIG. 3 is an underside view showing a cutting mechanism of the printing device. A cutter motor 36 drives a worm gear 38. This drives a gear train comprising three gears 40,42,44, the last gear 44 then driving a cam 46. The cam 46 has in its surface a cam track 48 extending circumferentially and asymmetrically. A tab cut lever arm 50 runs in the cam track 48 via a pin 52. The tab cut lever arm is pivotably mounted about a pivot point 54 and is arranged so that, as the cam rotates, it is brought into contact with the blade holder 56 to bring the blade 58 against the anvil.

Figure 5:
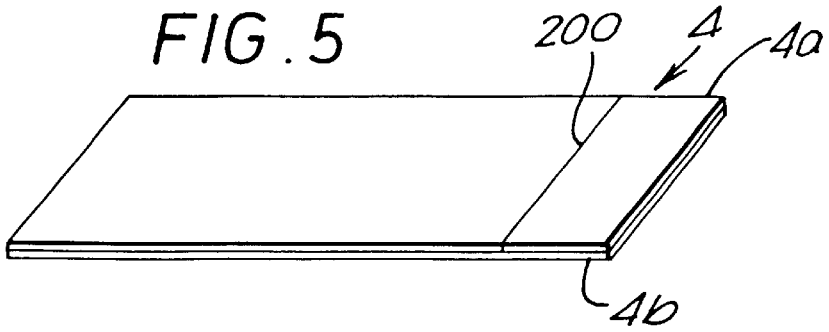
FIG. 5 shows a label with a tab cut.

When the image receiving tape 4 lies between the blade 58 and the anvil 60, the blade 58 cracks the upper polyester layer 4*a* while leaving the backing layer 4*b* intact to make a tab cut as designated by reference numeral 200 in FIG. 5. In the preferred embodiment and as described in our copending Application No. 9212423.9 a cut is simultaneously made through all of the layers of the image receiving tape to cut off a portion of tape once printed by two cooperating blades operating as scissors. The scissors can be driven by the motor 36 to cut off a portion of tape while the blade 58 makes the "tab-cut".

The cutting mechanism operates as follows. As the cam 46 rotates, the tab cut lever arm 50 is caused to move in the track 48 to bring the blade holder 56 from an inactive position spaced from the tape 4 into a cutting position where it brings the blade 58 against the anvil 60 with the tape in between. At the same time, the first scissor blade is brought into contact with the second scissor blade to perform a scissor cut. Thus, a portion of a printed tape is cut off while a tab cut 200 (see FIG. 5) is made at a short distance from the main cut.

Figure 6:
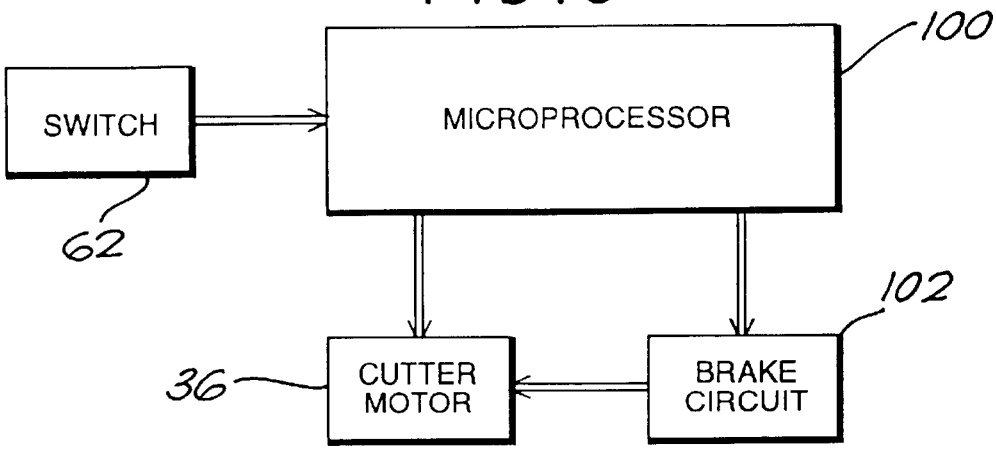
FIG. 6 is a block diagram of motor control circuitry.

The cutting mechanism operates with a dynamic braking system which will now be described. The cam 46 carries on its outer surface a protrusion 64. A microswitch 62 is mounted underneath the cassette receiving bay as shown in FIG. 3. FIG. 6 is a block diagram showing the main elements of the motor control circuitry. The microswitch 62 provides a signal to a microprocessor 100 for controlling the motor 36 and a brake circuit 102. The microswitch is normally open during rotation of the cam, except when the protrusion 64 is brought into contact with it, whereupon it is closed. The protrusion 64 is located so that it contacts the microswitch 62 in a position that the blade 58 is at its furthest location from the tape 4. The motor is an ordinary electric motor having a stator comprising permanent magnets which provide a magnetic field within which a wound rotor rotates. On receipt of a cut instruction, current is supplied to the rotor windings of the motor and the rotor rotates thus driving the worm gear 38, the gear train 40,42,44 and thence the cam 46. The cam 46 completes a full rotation bringing the blade 58 from its position furthest away from the tape 4 into contact with the tape to make a tab cut and then returning the blade 58 to its furthest position. In the basic implementation as described in our earlier Application, at this point the current supplied to the rotor windings of the motor is ceased. However, there is still a significant amount of inertial energy in the drive mechanism which means that the rotor of the motor continues to rotate for a short time even after current supply to the rotor windings has been cut off. This is prevented by the protrusion 64 coming into contact with the microswitch 62 with the blade 58 in its position furthest away from the tape. The microswitch passes a signal to the microprocessor 100 which responds by issuing a signal to the brake circuit 102 which acts to short circuit the terminals of the motor directly or through a low resistance thereby applying a braking torque and bringing the rotor rapidly to a standstill.

Reference is now made to FIGS. 4*a* to 4*e* to describe an accurately constructed tab cut assembly. FIG. 4*a* is a view of the tab cut assembly from one end, comprising the blade holder 56 with a blade 58. The blade holder 56 comprises an insert molded plastics body 57 having two supporting surfaces 57*a*,57*b* which extend on either side of the blade 58. It also has a lower protrusion 59 with angled surfaces by which the holder can be resiliently mounted in a support body 61 (see FIG. 2).

FIGS. 4*b* and 4*c* are side views of the plastics body 57, showing that it has a plurality of vertical ribs 104 on each side. FIG. 4*d* is a view from above of the body 57 and FIG. 4*e* is a section taken through the body 57 and showing the ribs and the blade in more detail. The ribs provide the body 57 with additional strength.

The assembly is such that the tip of the blade 58 protrudes beyond the support surfaces 57*a*,57*b* by a small but controllable amount, for example 100 to 120 microns, with a tolerance of the order of 20 um.

Figure 8:
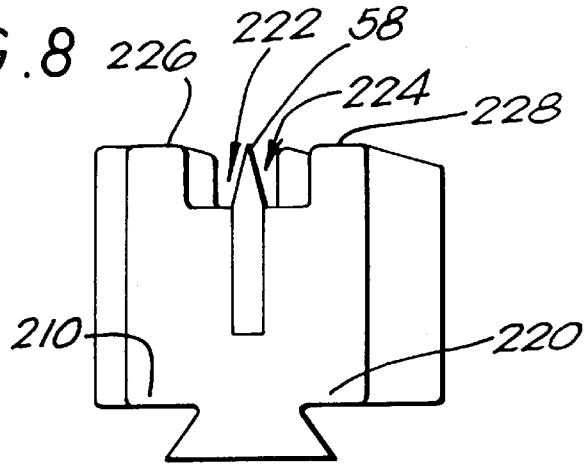
FIG. 8 shows an end view of the tab cut assembly of FIG. 4*a* in more detail.

FIG. 8 shows an end view of the molded tab cut assembly in more detail.

Reference numerals 210,220 show regions into which plastic can be injected into the mold in two balanced positions such that the blade 58 is not shattered, or the cutting edge damaged during injection of the plastic.

Grooves 222,224 are provided either side of the blade 58 to ensure that adhesive build-up in use does not stop the blade 58 from cutting through the upper layer of the tape by the correct distance.

The surfaces 226,228 of the support portions 57*a*,57*b* which define the controlled cutting depth can be molded accurately and are close enough to the blade that a flat, hard, support can be produced to allow reliable cutting to be achieved.

Features are included in the blade shape to ensure it is retained securely in the finished molding. Furthermore, the molded wall thicknesses are such that the component shrinks after cooling whilst maintaining the blade protrusion dimensions and tolerances.

Figure 7A:
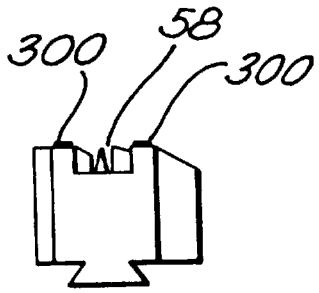
FIG. 7*a* is an end view of an alternative embodiment of the blade holder.
Figure 7B:
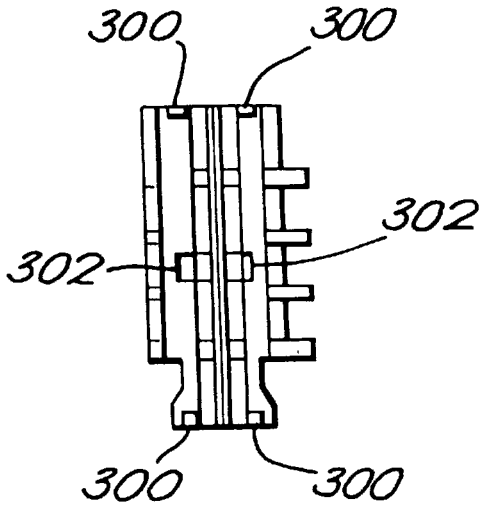
FIG. 7*b* is a view onto the cutting surface of the assembly of FIG. 7*a;*

FIGS. 7*a* and 7*b* are an end view and a top view of an alternative tab cut assembly in which the surface of the holder which faces the tape in use has four "pips" or protrusions 300 which help to stop the blade 58 damaging the anvil when no tape is present and also help to prevent the blade cutting through all the layers of a narrow (6 mm) tape. The surface also has central raised portions 302 which help to overcome tolerance problems when the blade assembly is made.

It is easier to control the smaller area of the raised portions 302 to overcome the problem of plastic shrinkage during molding.

Figure 9:
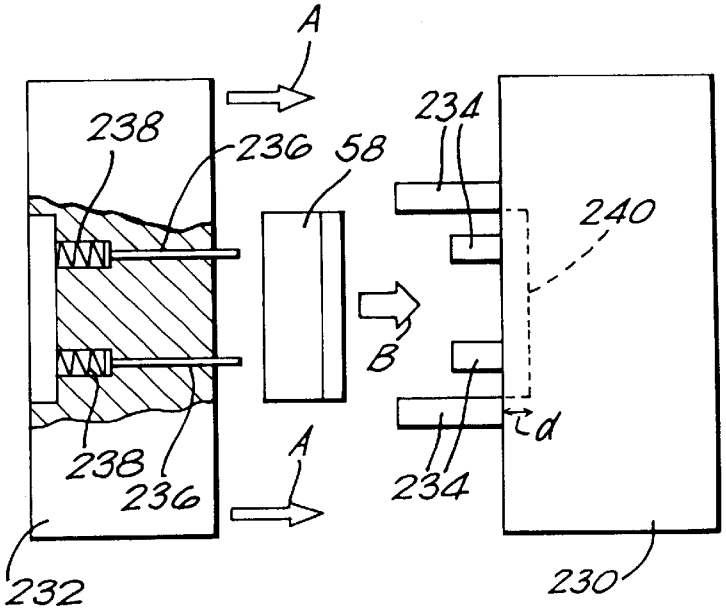
FIG. 9 is a side view of two mold halves of an insert molding assembly.

FIG. 9 is a side view showing two halves of an insert molding assembly for manufacturing the insert molded tab cut assembly described herein. The insert mold assembly comprises a fixed mold half 230 and a moving mold half 232. The mold halves 230,232 define, when mated, an inner mold cavity having a mold surface conforming to the desired shape of the blade holder 56. The fixed mold half 230 is provided with positioning pins 234 which serve to locate the blade 58 in a manner which will be described in more detail hereinafter with reference to FIG. 10. For a similar purpose, the moving mold half 232 is provided with spring-loaded pins 236, reference numeral 238 denoting the springs. The arrow A in FIG. 9 illustrates the direction of movement of the moving mold half 232 to the fixed mold half 230. The arrow B denotes the movement of the blade 58 towards the positioning pins, cutting side to the right in FIG. 9.

Figure 10:
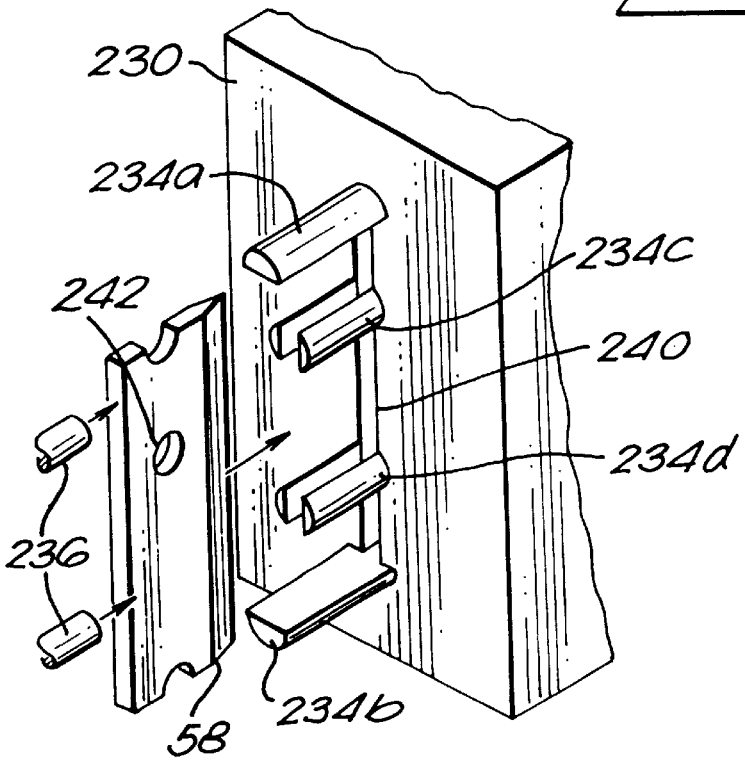
FIG. 10 shows the blade location in more detail.

FIG. 10 shows how the blade 58 is located against the fixed mold half 230. The spring-loaded pins of the moving mold half 232 cause the blade 58 to be sprung towards the positioning pins of the fixed mold half 230, thereby accurately guiding and locating it. The positioning pins 234 include upper and lower pins 234*a*,234*b* for guiding opposed longitudinal edges of the blade 58 and intermediate positioning pins 234*c*,234*d* which are split to receive and locate the blade on opposed surfaces thereof. The fixed mold half 230 is provided with a recess 240 which has a depth d defining the protruding height of the blade 58.

The blade 58 has an aperture 242 through which plastic material flows and thus causes the blade to be held firmly in the final molded holder. Another possibility is to provide vertical ribs which extend along opposite blade surfaces.

Thus, the present invention provides a system which reliably cuts a plastic label through from the front whilst leaving the peelable release layer substantially intact.

In addition it provides a system which can cut reliably tapes of differing widths, for example 6 mm, 12 mm and 19 mm in a fully automatic cutting system. The described cutter can cut the label tape reliably from the front to a very tightly controlled depth, typically 100 microns, for a 74 micron plastic tape having a total thickness of 135 microns including adhesive and peelable release layer. Further, the cutter anvil is not damaged and the blade has a long life.

These attributes are provided in one aspect by the ceramic blade which is insert molded into the plastic body to provide a very accurate blade protrusion distance. Insert molding and ceramic blades are of course known per se but the special combination required to achieve the desired performance for this application are new. In particular, by selecting the correct ceramic material and grinding conditions it is possible to produce a blade which can cut through the tape with forces of less than half that required with steel blades. Further, by selecting the correct plastic material for molding it is possible to achieve a blade protrusion tolerance of less than 20 microns. This tolerance is for example significantly less than the material shrinkage encountered during cooling after the molded process. Also, by correct design of the molding tool it is possible to ensure that the desired tolerances are achieved without damaging the ceramic blade, or its cutting edge, during the molding process.

What is claimed is:

1. A tape printer for printing images onto a multi-layer tape comprising:

a zone for holding a supply of multi-layer tape that has a plurality of layers;

a printing mechanism for printing images onto said multi-layer tape; and a tab cut mechanism for cutting through some but not all of the layers of the tape, the tab cut mechanism having a blade assembly which comprises:

a cutting blade having two sides and a cutting tip; and a holder for the cutting blade, the holder having first surfaces extending outwardly from the blade in a plane substantially parallel to the tape to be cut, through which the blade protrudes, and having supporting surfaces disposed on opposite sides of the cutting tip of the blade and fixed with respect to the blade, said supporting surfaces extending beyond the first surfaces but not beyond the cutting tip of the blade for preventing the blade from piercing all the layers of the tape, wherein the first surfaces are recessed from the cutting blade and supporting surfaces by a distance sufficient to form grooves that receive adhesive buildup during use to ensure cutting of the tape to the predetermined depth, and wherein the grooves include a third surface extending between the first surface and the supporting surface that is substantially perpendicular to the first surface and the supporting surface.

2. A tape printer according to claim 1, wherein the cutting tip of the blade extends beyond the supporting surfaces by about 100 to 120 microns.

3. A tape printer according to claim 1, wherein the cutting tip of the blade extend s beyond the supporting surfaces by about 95 to 120 microns.

4. A tape printer according to claim 1, wherein the blade is made from a ceramic material.

5. A tape printer according to claim 1, wherein the surface of the holder facing the tape in use has protrusions.

6. A tape printer according to claim 1, wherein the holder is comprised of an injection molded plastic.

7. A tape printer according to claim 1 in combination with a supply of multi-layer tape that has a plurality of layers, one of said layers having a predetermined thickness, wherein the portion of the blade protruding from the holder has a height which exceeds said thickness of the layer of tape to be cut by 20 to 45 microns.

8. A tape printer according to claim 1, wherein the first surfaces extend outwardly from the blade a distance greater than the thickness of the blade.

* * * * *